United States Patent [19]

Kwok

[11] 4,386,739

[45] Jun. 7, 1983

[54] NOZZLE FOR HYDROSTATIC FLUID TIP

[75] Inventor: Kui C. Kwok, Arden Hills, Minn.

[73] Assignee: Graco Inc., Minneapolis, Minn.

[21] Appl. No.: 332,089

[22] Filed: Dec. 18, 1981

[51] Int. Cl.[3] ..... B05B 7/08

[52] U.S. Cl. ..... 239/296; 239/426

[58] Field of Search ..... 239/290, 296, 298, 300, 239/424.5, 426, 431, 433, 434, 599, 418

[56] References Cited

U.S. PATENT DOCUMENTS 4,055,300 10/1977 Binoche ..... 239/296 X 4,232,824 11/1980 Binoche ..... 239/296 X

*Primary Examiner*—Andres Kashnikow

*Attorney, Agent, or Firm*—Paul L. Sjoquist

[57] ABSTRACT

A nozzle for utilization on a spray gun operated for the spraying of pressurized liquids through an elliptical orifice, wherein pressurized air is utilized in conjunction with the invention to enable an improved quality spray at a lower liquid pressure. The nozzle has a pair of air jets on either side of the elliptical orifice, positioned in diametrically opposite equidistant locations, and respectively directed along axes which cause the air jet envelope to tangentially contact the orifice at a point outside the included angle formed by the fan-shaped spray pattern emitted from the orifice.

5 Claims, 4 Drawing Figures

NOZZLE FOR HYDROSTATIC FLUID TIP

BACKGROUND OF THE INVENTION

The present invention is an improved construction for a spray gun, and is particularly adaptable for the construction of a paint spray gun operated under both the influence of pressurized air and pressurized spray liquid. More particularly, the invention is directed toward an improved nozzle design for utilization with a conventional airless spray tip of the type having an elliptical orifice through which liquid is sprayed under the influence of high liquid pressures.

In the field of liquid spraying, and more particularly in the field of paint spraying, it is desirable to produce a fan-shaped spray pattern of liquid particles which are finely and uniformly atomized. It has long been recognized as desirable that the spray pattern emanating from such a spray gun be elongated and generally elliptical in shape, rather than circular or some other shape. The elliptical, fan-shaped pattern enables a skilled operator to apply uniform paint coatings over both large and small surfaces.

In the art of spray painting, it is typical to spray at a distance of 6–18 inches from the article to be coated, and conventional airless spray tips typically develop a spray pattern width at the article to be coated in the range of 2–18 inches. In developing such a pattern, it has been long recognized that the critical problem area with respect to the development of a uniform pattern has occurred at the extreme edges of the fan-shaped pattern. For reasons not completely understood by those skilled in the art, an excess accumulation of paint spray particles tends to travel along either extreme edge of the spray pattern, and if particular care is not taken in the set-up and adjustment of the spray equipment these edge accumulations tend to develop "tails". The development of "tails" on an article being sprayed results in an excess accumulation of paint coating both above and below the main spray pattern, which excess coating is susceptible of collecting into droplets and destroying the uniformity of the coating finish. In an application utilizing airless spray equipment it is usually possible to eliminate such "tails" by merely increasing the liquid paint pressure in the system. However, this results in other adverse effects, for in typical operating equipment it is usually necessary to operate at liquid pressures in the range of 1500–3000 pounds per square inch (p.s.i.), requiring the design of equipment capable of withstanding such pressures.

Efforts directed toward solving the problem of providing uniform spray under lower pressure airless paint spraying conditions resulted in the first successful invention accomplishing this, are disclosed in U.S. Pat. No. 3,843,052. In this patent, it was revealed that a low-pressure air stream could be directed at the flat liquid fan emanating from the orifice at a point prior to the zone of atomization of the fan, and this would enable a significant reduction in the liquid pressures required for uniform atomization. Subsequently, other patents issued which disclose various forms of air jet construction for accomplishing this end. For example, U.S. Pat. No. 3,907,202, issued Sept. 23, 1975, discloses an airless spray gun having an annular air orifice concentric to the liquid paint orifice, and at least two air orifices disposed on either side of the nozzle for directing air jets onto the flat fan-shaped paint film emanating from the paint orifice. U.S. Pat. No. 4,055,300, issued Oct. 25, 1977, discloses a hydrostatic atomizing nozzle having a pair of air orifices disposed on either side of the nozzle to deliver air jets in a plane perpendicular to that of the flat paint film, but directed toward the front surface of the frusto-conical liquid nozzle so as to bounce the air stream off the nozzle prior to contacting the flat paint film. U.S. Pat. No. 4,219,157, issued Aug. 26, 1980, discloses a hydrostatic atomization nozzle having at least two complementary jets of compressed air coplanar with the paint liquid fan and converged towards the paint liquid fan at a point displaced forward of the paint nozzle. U.S. Pat. No. 4,232,824, issued Nov. 11, 1980, discloses a hydrostatic atomizing nozzle having a plurality of air jets directed both at the liquid nozzle surface and also parallel to the liquid nozzle surface, the claimed result of all of the air passages being an improved atomization of the paint pattern.

SUMMARY OF THE INVENTION

Briefly, the invention includes a nozzle for utilization on an airless spray gun wherein an elliptical orifice is required for atomization of the paint, and for forming the paint into a flat fan-shaped pattern. The nozzle has a pair of air jet openings positioned on either side of the liquid orifice ellipse major axis, the respective pairs of air jets positioned diametrically opposite each other and indirectly facing relationship. The axis of each air jet is nearly tangential to the surface of the spray tip, but positioned outside of the included angle formed by the flat fan-shaped liquid sheet emanating from the spray tip.

It is a principal object of the present invention to provide a nozzle for utilization in an airless spray gun in a manner to improve the quality of the spary emanated therefrom.

It is a further object of the present invention to provide a nozzle having air jets directed to disturb the "tails" of the planar fan-shaped film emitted from the liquid orifice, at the respective edges of the fan-shaped film.

BRIEF DESCRIPTION OF THE DRAWINGS

The foregoing and other objects will become apparent from the following specification, and with reference to the appended drawings, in which.

DESCRIPTION OF THE PREFERRED EMBODIMENT

Figure 1:
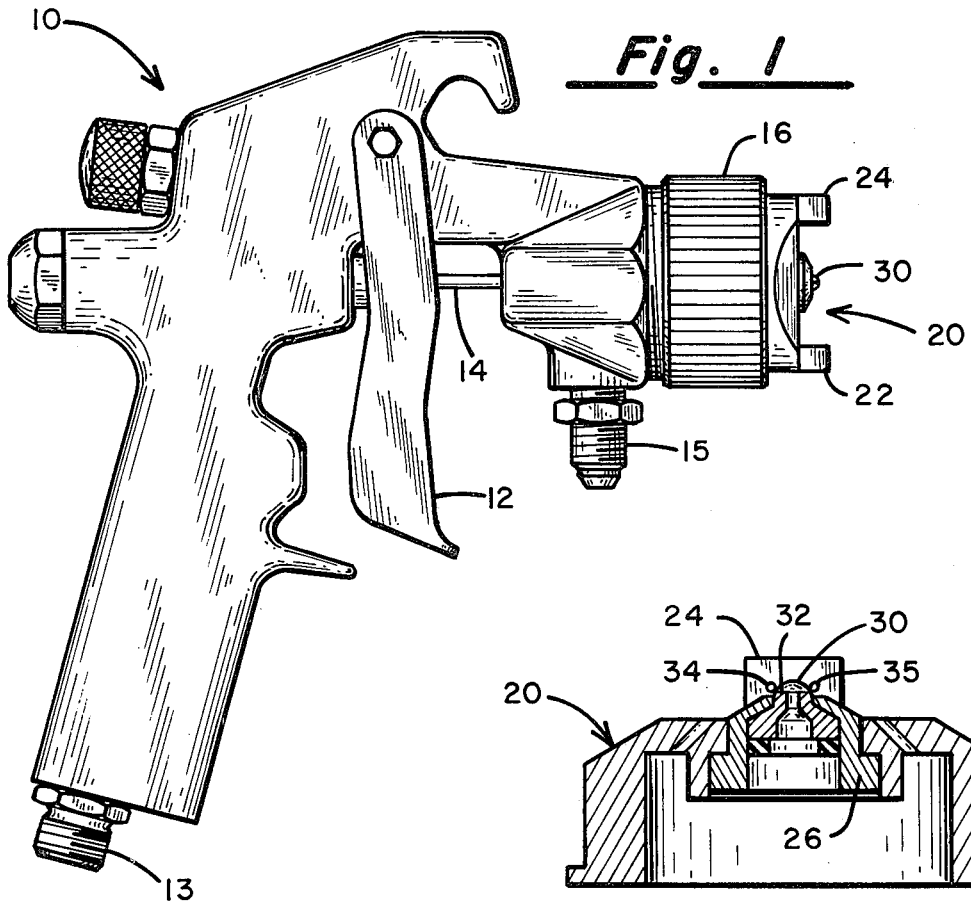
FIG. 1 shows a spray gun of the type utilized with the present invention.

Referring first to FIG. 1, there is shown a spray gun 10 of the type preferably utilized with the present invention. Spray gun 10 has an air coupling 13 and internal air passages to provide a supply of pressurized air to nozzle 20. Spray gun 10 also has a liquid coupling 15 for connection to a source of pressurized liquid, preferably paint, for spraying. Internal passages in spray gun 10 convey the pressurized liquid from coupling 15 to the spray orifice in nozzle 20 as will hereinafter be described. A trigger 12 may be actuated by an operator, causing a valve rod 14 to open the liquid passages to permit liquid to pass through the spray orifice of the spray gun. A threaded locknut 16 secures nozzle 20 to the end of spray gun 10. Nozzle 20 has at least two horns 22 and 24 projecting forwardly of the nozzle, each of the horns having air jets as will be hereinafter described.

Figure 2:
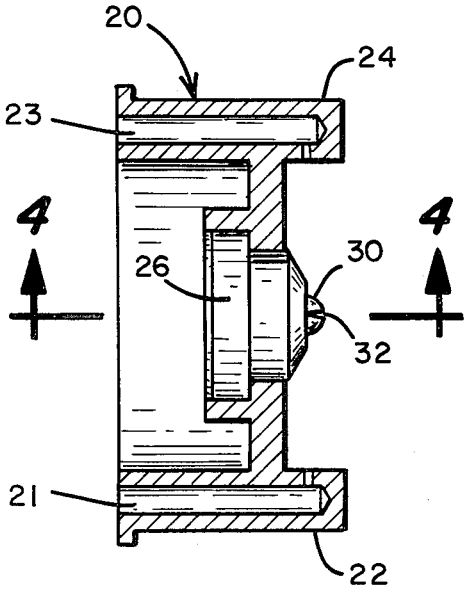
FIG. 2 shows a cross-sectional view of a nozzle.

FIG. 2 shows a cross-sectional view of nozzle 20. An air passage 21 is formed in nozzle 20 extending into the region of horn 22. A second air passage 23 is formed in nozzle 20 and extends into the region of horn 24. A spray tip holder 26 is axially seated in nozzle 20, and has a spray tip 30 projecting through the front of nozzle 20 and holder 26.

Figure 3:
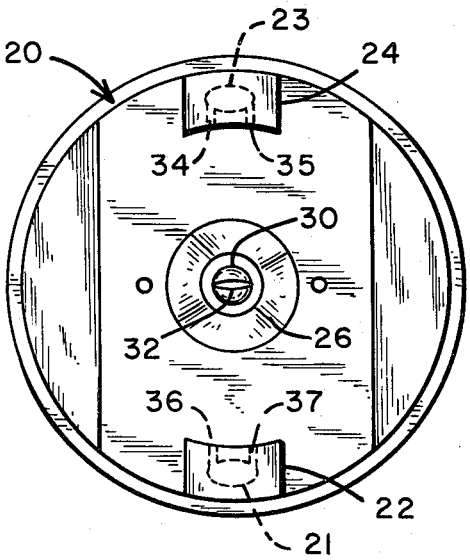
FIG. 3 shows an end view of the nozzle of FIG. 2.

FIG. 3 shows a front view of nozzle 20. Horns 22 and 24 are diametrically opposite one another, and are equally spaced from spray tip 30. Spray tip 30 has an elliptical orifice 32 generally as shown, and horns 22 and 24 are aligned on either side of the major axis of the elliptical orifice 32. A pair of air jet holes, 34, 35 open through the center-facing wall of horn 24, and into air passage 23. Similarly, a pair of air jet holes 36, 37 open through the center-facing wall of horn 22 and into air passage 21. Air jet hole 34 is aligned directly opposite air jet hole 36, and air jet hole 35 is aligned directly opposite air jet hole 37. Further, an axial line connecting air jet holes 34 and 36 nearly tangentially crosses the surface of spray tip 30, and an axial line drawn between air jets 35 and 37 similary nearly tangentially crosses the surface of spray tip 30. In each case, the point of crossing of the axial interconnection between the respective air jet holes is outside of the included angle which would be formed by the emanation of a flat fan-shaped spray pattern from orifice 32.

Figure 4:
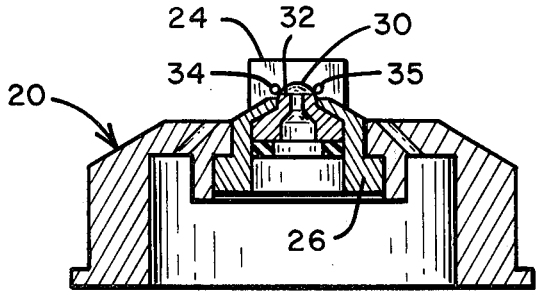
FIG. 4 shows a view taken along the lines 4—4 of FIG. 2.

FIG. 4 shows a cross-sectional view taken along the lines 4—4 of FIG. 2. Spray tip 30 is seated within spray tip holder 26, and spray tip holder 26 is secured in the position shown. In this position, elliptical orifice 32 is centered between the respective air jet holes 34, 35. An imaginary cylinder having an outside diameter equal to the diameter of air jet hole 34 or 35, if it were axially extended to spray tip 30, would have its outer surface in tangential contact with the outer surface of spray tip 30.

In operation, under typical airless spray painting conditions, a source of pressurized liquid, preferably paint, is connected to coupling 15 and to the spray nozzle whenever the spray gun trigger is actuated. Pressurized spray emitted from the elliptical orifice in the spray tip tends to be shaped into a flattened fan-shaped form from the orifice. The edges of the flat, fan-shaped spray pattern define an included angle in approximate centered alignment between the two pairs of air jets in the nozzle horns. These air jets impinge upon each other and deflect toward the fan-shaped pattern, and thereby disturb the edges of the flat fan-shaped film pattern, so as to cause the "tails" of the pattern to begin breaking up and atomizing. Because of the tendency for excess liquid to accumulate along the pattern edges in the form of a very fine liquid stream, the air jets succeed in disturbing this very fine liquid stream sufficiently to cause it to break up and begin atomizing, and thereby improving uniformity of the fan-shaped pattern and atomization thereof as it progresses toward the article to be coated.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a spray gun of the type where pressurized liquid is forced through a generally elliptical orifice in a spray tip to achieve atomization of the liquid, and compressed air is selectively directed against the sprayed liquid through selectively placed air jets in an atomizing nozzle, the improvement in atomizing nozzle construction comprising:

(a) a pair of projecting horns on said atomizing nozzle, said horns extending forwardly of said orifice and each horn having therein an air passage for receiving compressed air; and (b) a pair of air jets in each of said horns, in flow communication with said air passage and opening toward said elliptical orifice, each of said air jets being aligned along an axis which is normal to the major axis of said elliptical orifice, the axis of each of said pair of air jets being in alignment with the axis of an oppositely facing air jet and passing in proximate tangential relationship to said spray tip.

2. The improvement of claim 1, wherein said respective horns are spaced equidistant from said elliptical orifice along a line which is normal to the major axis of said elliptical orifice.

3. The improvement of claim 2, wherein each of said air jets has the same predetermined diameter and the axis of said air jets is positioned so that a cylindrical extension of said air jets of said predetermined diameter will tangentially contact said spray tip.

4. The improvement of claim 3, wherein said air jets are directed outside the included angle of pressurized liquid forced through said spray tip orifice.

5. The improvement of claim 4, wherein said oppositely facing air jets are positioned to direct pressurized air into disturbance relationship to the flow of the edges of pressurized liquid forced through said spray tip orifice.

* * * * *